United States Patent [19]

James

[11] 4,162,579

[45] Jul. 31, 1979

[54] ARCHERY SIGHT

[76] Inventor: Wakelf James, P.O. Box 16, Hagar Shores, Mich. 49039

[21] Appl. No.: 905,166

[22] Filed: May 12, 1978

[51] Int. Cl.[2] ..... F41G 1/00; F41B 5/00

[52] U.S. Cl. ..... 33/265; 124/87

[58] Field of Search ..... 33/265, 254; 124/87

[56] References Cited

U.S. PATENT DOCUMENTS

| | | | |
|---|---|---|---|
| 211,763 | 1/1879 | Matthews | 33/254 |
| 404,599 | 6/1889 | Carver | 33/253 |
| 1,365,236 | 1/1921 | Fletcher et al. | 33/253 |
| 2,559,927 | 7/1951 | Beloungy | 33/265 |
| 2,982,026 | 5/1961 | Peterson | 33/265 |
| 3,015,328 | 1/1962 | Ryder | 33/265 |
| 3,058,221 | 10/1962 | McNeel | 33/265 |
| 3,648,376 | 3/1972 | Millnamow | 33/265 |
| 3,667,444 | 6/1972 | Depatie et al. | 33/265 |
| 3,822,479 | 7/1974 | Kowalski | 33/265 |
| 3,871,105 | 3/1975 | Brougham | 33/265 |

OTHER PUBLICATIONS

Brochure from Altier Archery Manufacturing, Honesdale, Pa.

*Primary Examiner*—Steven L. Stephan

*Attorney, Agent, or Firm*—Blanchard, Flynn, Thiel, Boutell & Tanis

[57] ABSTRACT

An archery sighting device which includes an elongated arm formed by front and rear arm portions which are adjustably connected to permit appropriate horizontal or vertical adjustment therebetween. The front arm portion is attached to the bow, adjacent the hand grip, and projects forwardly thereof. A front sight structure is mounted adjacent the forward end of the front arm portion. The rear arm portion projects rearwardly a substantial distance beyond the normal relaxed position of the bow string and is provided with a rear sight structure at the rearward end thereof. One of these sight structures, normally the front sight structure, is adjustable and includes a plurality of different sighting pins which are representative of different shooting distances. In a desired embodiment, this adjustable sight structure includes a rotary member having a plurality of different sighting pins projecting radially therefrom in angularly spaced relationship, which pins can be selectively individually disposed in the sighting position depending upon the selected shooting distance.

9 Claims, 7 Drawing Figures

ARCHERY SIGHT

FIELD OF THE INVENTION

This invention relates to an improved archery sight and, in particular, to a sight which can be easily adjusted to compensate for different shooting distances while permitting accurate shooting of an arrow.

BACKGROUND OF THE INVENTION

Numerous sighting devices have been devised for use on archery bows. Most of these known devices, however, have not proven satisfactory to a great majority of archers. One of the primary disadvantages of many known sighting devices is their difficulty of adjustment so as to compensate for different shooting distances. A further disadvantage is that the known sights often have not permitted the desired shooting accuracy. Still a further disadvantage is that most known sights employ only a single sighting element or pin mounted adjacent the bow, and the archer utilizes in conjunction therewith a sighting eyelet positioned in the bow string. However, sighting devices relying upon structures of this type introduce additional complications and inaccuracies inasmuch as each archer normally positions the drawn string in a slightly different positional relationship relative to his body, depending upon his own shooting style, and this accordingly makes such devices difficult to adjust and of undependable accuracy. Still further, the known sighting devices have not possessed sufficient adjustments in the various directions, that is both horizontally and vertically, nor have they possessed independently adjustable front and rear sights so as to permit the sighting device to be individually adjusted to best suit each archer's needs.

Several known archery sights are disclosed in the following United States patents: Smith U.S. Pat. No. 4,026,032, Brougham U.S. Pat. No. 3,871,105, Brougham U.S. Pat. No. 3,849,894, Diamond U.S. Pat. No. 3,674,002, Depatie et al U.S. Pat. No. 3,667,444, Millnamow U.S. Pat. No. 3,648,376, McNeel U.S. Pat. No. 3,058,221, Ryder U.S. Pat. No. 3,015,328, and Beloungy U.S. Pat. No. 2,559,927. These patents disclose sights possessing structural and operational features possessing one or more of the disadvantages noted above.

Accordingly, it is an object of this invention to provide an improved archery sight which is believed to overcome the above-mentioned disadvantages. More specifically, the improved archery sight of this invention permits the sight to be simply and efficiently adjusted so as to accommodate each archer's shooting position, while at the same time permitting the archer to shoot with a high degree of accuracy for any selected shooting distance.

The improved archery sight of this invention also posseses an adjustable structure which enables the sight to be easily selectively adjusted so as to accommodate different shooting distances, while at the same time permitting shooting with a high degree of accuracy. This improved sight also includes structure which permits the sight to be adjusted in transverse directions, and also permits independent adjustment between the front and rear sights.

The sighting device preferably incorporates an elongated arm which is attachable to the bow and extends substantially transversely thereof, with a front sight being mounted adjacent the front end of the arm in close proximity to the bow, and a rear sight being mounted at the other end of said arm and positioned rearwardly a substantial distance from the normal relaxed position of the string, whereby the rear sight can be disposed in close proximity to the archer's eye when the bow string is drawn back. These front and rear sights are fixedly, but adjustably, positioned relative to one another to provide the archer with very accurate alignment with the target. In a desired embodiment, the front sight is formed as a selectively rotatable member having a plurality of sighting pins projecting therefrom, with one pin being selectively positionable in the sighting location, whereby rotation of the member enables different sighting pins corresponding to different shooting distances to be quickly and accurately moved into the sighting position.

This invention also relates to an improved sighting device, as aforesaid, which can be manufactured efficiently and economically so as to be saleable at a reasonable price, which can be readily attached to substantially any conventional bow without requiring any substantial modification thereof, which is extremely durable, which possesses numerous adjustment features so as to be positionable and usable in a form deemed most desirable according to the needs of each individual archer, and which permits shooting with a high degree of accuracy provided that the device is properly utilized by the archer.

Other objects and purposes will be apparent upon reading the following specification and inspecting the accompanying drawings.

Figure 1:
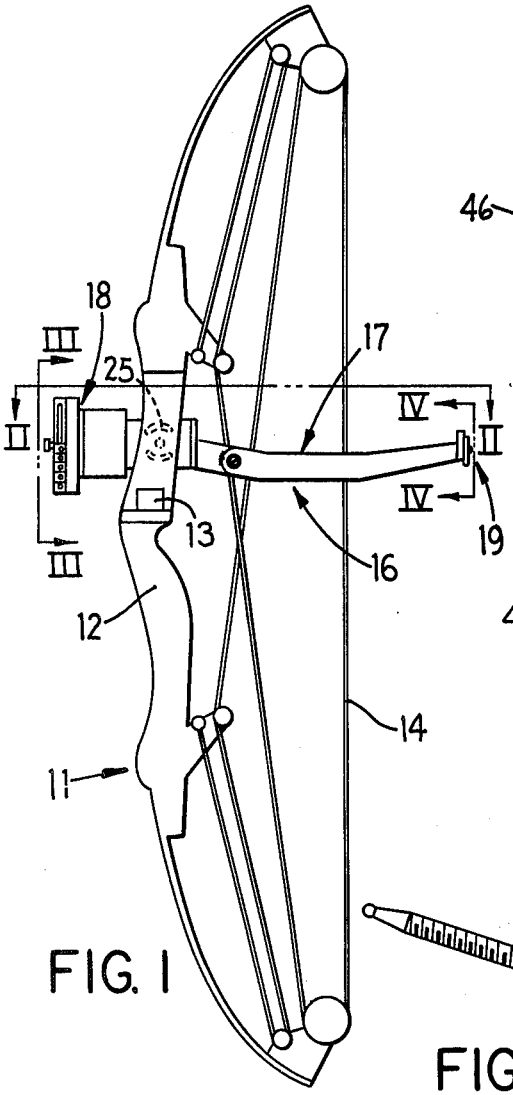
FIG. 1 illustrates a side elevational view of a conventional compound bow having the improved archery sighting device of this invention mounted thereon.

Certain terminology will be used in the following description for convenience in reference only and will not be limiting. For example, the words "rightwardly", "leftwardly", "upwardly" and "downwardly" will refer to directions in the drawings to which reference is made. The word "front" will refer to the outer end of the bow sight, namely the leftwardmost end as appearing in FIGS. 1, 2 and 5, and the word "rear" will have reference to the opposite end of the bow sight, namely that end which is positioned more closely adjacent the archer's face. Said terminology will include the words specifically mentioned, derivatives thereof and words of similar import.

SUMMARY OF THE INVENTION

The objects and purposes of this invention, including those mentioned above, have been met by providing a sighting device which includes an elongated arm formed by front and rear arm portions which are adjustably connected to permit appropriate horizontal or vertical adjustment therebetween. The front arm portion is attached to the bow, adjacent the hand grip, and projects forwardly thereof. A front sight structure is mounted adjacent the forward end of the front arm portion. The rear arm portion projects rearwardly a substantial distance beyond the normal relaxed position of the bow string and is provided with a rear sight structure at the rearward end thereof. One of these sight structures, normally the front sight structure, is adjustable and includes a plurality of different sighting pins which are representative of different shooting distances. In a desired embodiment, this adjustable sight structure includes a rotary member having a plurality of different sighting pins projecting radially therefrom in angularly spaced relationship, which pins can be selectively individually disposed in the sighting position depending upon the selected shooting distance.

DETAILED DESCRIPTION

FIG. 1 illustrates therein a conventional compound bow 11 having a central hand grip portion 12, an arrow rest 13, and a bow string 14, the latter being shown in its normal relaxed position. The structure and operation of the bow 11 is well known.

Figure 3:
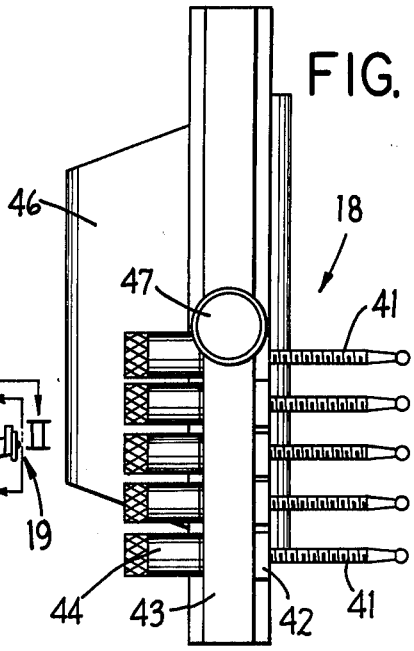
FIG. 3 is an enlarged front view of the front sight as taken along line III—III in FIG. 1.
Figure 4:
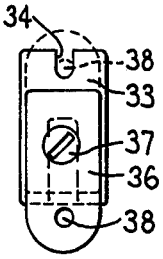
FIG. 4 is an enlarged rear view of the rear sight as taken along line IV—IV in FIG. 1.
Figure 2:
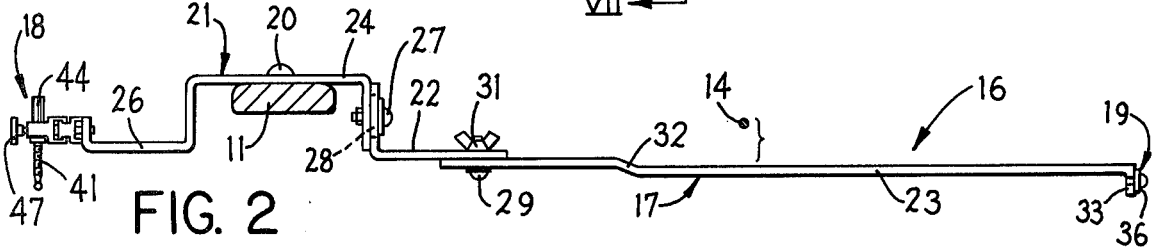
FIG. 2 is an elongated top view of the archery sight device as taken substantially along line II—II in FIG. 1.

According to the present invention, the bow 11 is provided with an improved sighting device 16 associated therewith, which device 16 is shown in detail in FIGS. 2–4.

The sighting device 16 comprises an elongated arm structure 17 which is connected to the bow directly above the arrow rest 13 and is provided with front and rear sights 18 and 19, respectively, at opposite ends thereof. This arm structure 17 includes a front arm portion 21, an intermediate arm portion 22 and a rear arm portion 23.

The front arm portion 21 is releasably fixed to the bow directly above the arrow rest, as by one or more threaded screws 20. These screws extend through openings or arcuate slots 25 and are threadably engaged with the bow, whereby the arm portion 21 can be initially angularly adjusted as desired with respect to the bow, and then fixedly positioned by means of the screws. This mounting arrangement also permits an arrow holder to be attached to the bow in overlying relationship to a portion of the arm 21 if desired. The rear portion of the arm 21 is of a substantially channel-shaped configuration so as to effectively wrap around the bow on both the front and rear sides thereof, and this channel-shaped portion terminates in a substantially planar forward portion 26 which projects forwardly of the bow on the same side thereof as the arrow rest.

The rear leg of the channel portion 24 overlaps one leg of the L-shaped intermediate arm portion 22, the latter portions being fixedly joined together by a threaded bolt 27. This bolt extends through a horizontally elongated slot 28 formed in the arm portion 22 to permit a desired sideward or horizontal adjustment therebetween.

The rear leg of the L-shaped intermediate arm portion 22 overlaps the front of the rear arm portion 23, being fixed thereto by a threaded bolt 29 having a wing nut 31 associated therewith, whereby this bolt can be easily released to permit the rear arm portion 23 to be vertically angularly adjusted relative to the L-shaped arm portion 22, thereby permitting vertical adjustment of the rear sight 19.

The rear arm portion 23 is provided with a sideward offset 32 intermediate the ends thereof to provide additional clearance for movement of the string 14 during shooting. This rear arm portion 23 is of substantial length such that it projects rearwardly of the bow a substantial distance, whereby the rear sight 19 is thus disposed a substantial distance rearwardly from the string 14 when the latter is in its normal relaxed position. Accordingly, when the string is drawn backwardly during utilization of the bow, the rear sight 19 can be positioned in close proximity to the archer's eye to provide for proper sighting of the arrow. This rear sight 19, however, is normally spaced sidewardly from the string since most archers prefer to draw the string backwardly to a position adjacent the cheek or mouth, so that the rear sight is thus disposed sidewardly sufficiently to compensate for the sideward positioning of the string relative to the archer's eye.

The rear sight 19, as illustrated in FIG. 4, is formed by a platelike flange 33 which is integral with the rear arm portion 23 and is bent sidewardly from the rear free end thereof in substantially perpendicular relationship. The upper edge of this flange 33 has an upwardly opening sighting slot 34 formed therein. The flange 33 also has a sight plate 36 attached thereto, as by a screw 37, which plate has a sighting hole 38 formed therethrough. By loosening the screw 37, plate 36 can be swung upwardly into an upper position wherein the hole 38 is aligned with the lower end of the slot 34, as indicated by dotted lines, whereby the screw 37 is then retightened so that the archer can utilize a sighting hole rather than a slot, if desired.

Considering now the front sight 18, same includes a plurality of substantially identical sight pins 41 each secured to a slide block 42, which blocks 42 are individually slidable within a vertically elongated guide housing 43, the individual blocks 42 being fixed relative to the housing by individual thumb screws 44.

The vertically elongated guide housing 43 is in turn vertically adjustably mounted on a bracket 46, being secured thereto by a thumb screw 47. The bracket 46 is in turn fixedly attached, as by means of screws, to a transverse flange which is formed integral with the forward edge of the plate portion 26. The plurality of sight pins 41 are vertically spaced apart and project sidewardly of the bow, substantially as illustrated in FIG. 2, directly above the arrow rest, so as to represent various shooting distances.

The adjustable front sight 18 as described above, wherein there is provided a vertically elongated slide-like housing having a plurality of individually adjustable vertically spaced pins, is conventional, such a structure being illustrated in the aforementioned Smith U.S. Pat. No. 4,026,032.

As is believed apparent from the above description, the archery sighting device 16 can be easily adjusted to permit it to comfortably fit each archer, and specifically each archer's own shooting position. The rear arm portion 23 can be horizontally sidewardly displaced by appropriate loosening of the bolt 27. The rear sight 19 can also be vertically adjusted by loosening the wing nut 31. By loosening the screw 37, the sight plate 36 can be swung upwardly or downwardly to there provide the rear sight with either a sighting notch or a sighting hole. The front sight 18 is also independently adjustable relative to the rear sight, since the complete front sight can be vertically adjusted by moving the housing 43 vertically relative to the bracket 46, and the individual pins 41 can themselves be individually vertically adjusted. When so adjusted, the bow can then be utilized to permit accurate sighting of an arrow at selected targets disposed at different distances. The operation of the bow, including the positioning of the arrow and the shooting thereof, is well understood by those familiar with archery equipment.

Figure 7:
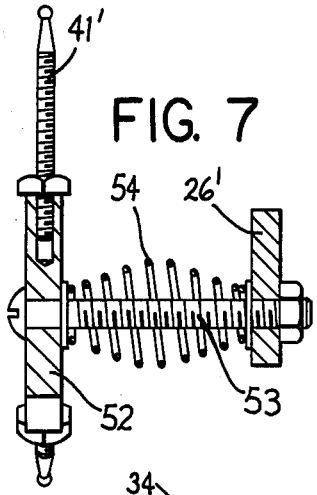
FIG. 7 is a sectional view taken along line VII—VII in FIG. 6.
Figure 6:
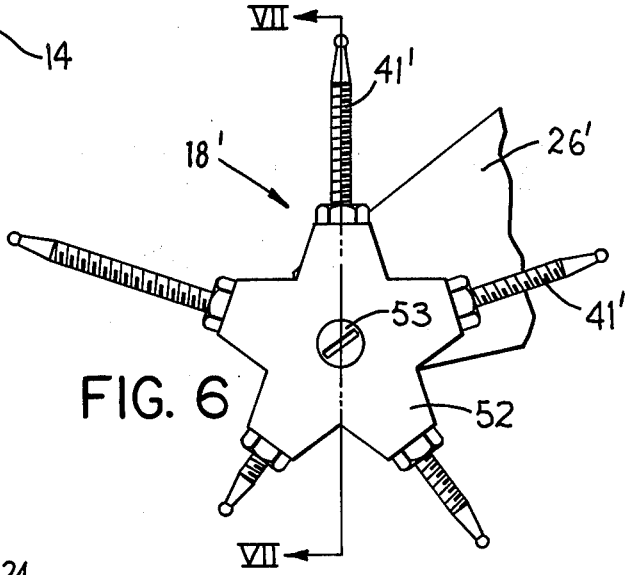
FIG. 6 is an enlarged fragmentary side view as taken substantially along line VI—VI in FIG. 5.
Figure 5:
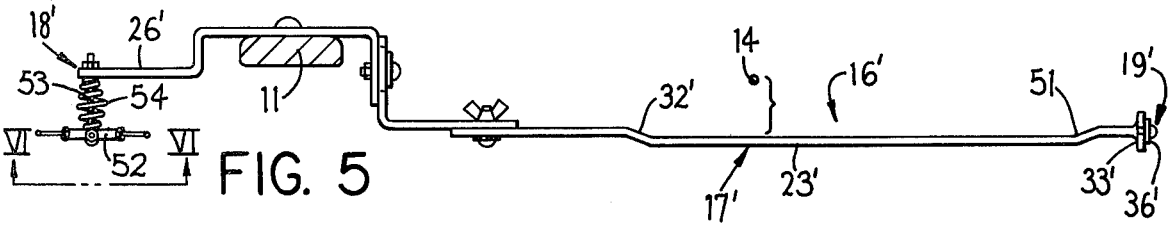
FIG. 5 is a top view similar to FIG. 2 but illustrating another embodiment of the improved archery sighting device.

Referring now to FIGS. 5–7, there is illustrated a modified sighting device 16' according to the present invention. The parts of the device 16' have been designated by the same reference numerals utilized to designate corresponding parts of the device 16, but with the addition of a prime (') thereto.

The sighting device 16' utilizes the same basic elongated arm structure 17' except that the rear arm portion 23' is provided not only with the front offset 32', but is also provided with a further rear offset 51 which is identical to but reversely oriented from the offset 32'. The remainder of the sighting device 16', except for the front sight 18', is otherwise identical to the above-described device 16.

The front sight 18' again includes a plurality of sight pins 41'which are fixed to and project radially outwardly from a rotatable support 52. The sight pins 41' are equally angularly spaced around the rotatable support 52, and project radially outwardly through different distances so as to permit the sight device to be set corresponding to different shooting distances. The support 52 is rotatably mounted on the outer end of an elongated rod 53, a screw in the illustrated embodiment, which rod is secured to the front end of the plate portion 26' and projects horizontally sidewardly therefrom. A compressed coil spring 54 surrounds the rod 53 and is compressed between the plate portion 26' and the support member 52 to thereby exert sufficient frictional force against the side of the support 52 so as to stationarily hold same in a selected position. If desired, a conventional detent device can be provided for coacting with the five different positions on the support 52 to releasably hold it so that the selected alignment pin 41' projects vertically upwardly.

In use, the support 52 is manually rotated until the desired alignment pin 41' projects vertically upwardly, whereupon the upper end of this selected alignment pin is used in conjunction with the rear sight 19' for sighting the arrow on the target. The shortest pin 41' is obviously used for a short shooting distance, with the progressively longer pins 41' being used as the shooting distance increases, thereby compensating for the increased vertical drop of the arrow during its flight. This front sight 18' is particularly desirable since only a single alignment pin projects vertically upwardly, and hence the archer does not become confused, such as may occur when utilizing a front sight of the type illustrated in FIG. 3. At the same time, the archer can readily rotate the support 52 to select the proper alignment pin depending upon the shooting range, which adjustment can be made very rapidly and efficiently.

Other than the adjustment of the front sight 18', as explained above, the sighting device 16' is in other respects adjusted and operated in the same manner as the sighting device 16 described above.

In both of the above-described embodiments, the horizontally elongated arm 17 or 17' has the sections thereof formed from substantially thin platelike material since this enables the arm to be of minimum weight while still having substantial strength and rigidity. Further, this also results in minimum thickness when the archer sights along the arm, and hence creates no significant visual distraction or interference with the archer's unobstructed vision along the sight toward the target.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An archery sighting device for fixed attachment to a bow in the vicinity of the hand grip portion thereof, said sighting device comprising:

horizontally elongated arm means having an intermediate portion for fixed connection to the bow;

front sight means mounted on said arm means adjacent the forward end thereof so as to be positioned adjacent but forwardly of said bow;

rear sight means mounted on the rearward end of said arm means at a position disposed rearwardly of the bow string when the latter is in its nondrawn position;

said front sight means including a plurality of individual sighting elements which are selectively individually usable in conjunction with said rear sight means depending upon the distance between the bow and the target;

said elongated arm means including front and rear elongated arm sections which individually extend substantially longitudinally of the arm means and are disposed substantially in end-to-end relationship, said front arm section being releasably secured to said bow and projecting both forwardly and rearwardly thereof, said front sight means being mounted on the front end of said front arm section, and said rear arm section projecting rearwardly from said front arm section and having said rear sight means mounted on the rear end thereof; and releasable connecting means for joining together the front and rear ends of said rear and front arm sections respectively, for permitting the rear arm section to be vertically angularly adjusted relative to said front arm section about a substantially horizontal adjustment axis to vertically adjust the position of said rear sight means.

2. A sighting device according to claim 1 wherein said front sight means comprises a support member rotatably supported on said arm means and having a plurality of said sighting elements fixed thereto and projecting radially outwardly therefrom in angularly spaced relationship, said sighting elements projecting radially outwardly through different distances as measured from the rotational axis of said support

3. A sighting device according to claim 2, wherein said support member is mounted on said arm means adjacent the front end thereof and is rotatable about a substantially horizontal axis.

4. A sighting device according to claim 3, wherein said rear sight means includes adjustment means associated therewith for selectively providing either a peephole or a sighting notch.

5. A sighting device according to claim 1, wherein said rear sight means includes a first sight member fixed to said rear arm section and having a notch-type sight formed in one edge thereof and a second sight member having a peephole-type sight formed therethrough, said first and second sight members being substantially superimposed one over the other, and means connecting said first and second sight members together for permitting said second sight member to be adjustably moved between a first position wherein said notch-type sight is utilized and a second position wherein said peephole-type sight is substantially aligned with and overlies said notch-type sight.

6. A sighting device according to claim 1, wherein said connecting means also includes means adjoining said front and rear arm section for permitting said rear arm section to be horizontally sidewardly adjusted relative to said front arm section.

7. A sighting device according to claim 6, wherein said arm sections are formed from thin platelike material having a thin horizontal dimension and a substantial vertical dimension, said front arm section having a sidewardly opening channel-shaped part which receives therein said bow for fixedly connecting said front arm section to said bow on one side thereof, said channel portion having projecting legs disposed adjacent the front and rear edges of the bow and projecting to the other side thereof so that said front and rear sights are located on said other side of the bow.

8. A sighting device according to claim 7, wherein said rear sight means includes a platelike flange which is fixed to the rear free end of said rear arm section and projects sidewardly therefrom in substantially perpendicular relationship thereto, said flange having a notch-type sight formed in the upper free edge thereof, and a sighting plate overlying said flange and having a peephole-type sight extending therethrough, said sighting plate being movably connected to said flange for movement between an inactive position permitting use of the notch-type sight and an active position wherein the peephole-type sight is aligned with the notch-type sight.

9. An archery sighting device for fixed attachment to a bow in the vicinity of the hand grip portion thereof, said sighting device comprising:

horizontally elongated arm means having an intermediate portion for fixed connection to said bow, said arm means having the forward end thereof positioned adjacent but forwardly of said bow, and said arm means having the rearward end thereof disposed rearwardly of the bow string when the latter is in its nondrawn position;

front sight means mounted on said arm means adjacent the forward end thereof so as to be positioned adjacent but forwardly of said bow;

rear sight means mounted on the rearward end of said arm means so as to be normally disposed rearwardly of the bow string when in its nondrawn position;

said front sight means including a plurality of individual sighting elements which are selectively usable in conjunction with said rear sight means depending upon the distance between the bow and the target; and said rear sight means including a first sight member mounted on said arm means adjacent the rearward end thereof and having a notch-type sight formed in one edge thereof, said rear sight means also including a second sight member having a peephole-type sight formed therethrough, said first and second sight members being substantially superimposed one over the other, and means for permitting said second sight member to be adjustably moved relative to said first sight member between a first position wherein said peephole-type sight is in a non-use position so that said notch-type sight is utilized and a second position wherein said peephole-type sight is substantially aligned with and overlies said notch-type sight.

* * * * *